United States Patent [19]

O'Neill

[11] 4,081,128

[45] Mar. 28, 1978

[54] DISPENSER BOX CONSTRUCTION

[75] Inventor: James L. O'Neill, Norfolk, Mass.

[73] Assignee: Merkert Enterprises, Inc., Canton, Mass.

[21] Appl. No.: 765,816

[22] Filed: Feb. 4, 1977

[51] Int. Cl.[2] ..... B65D 5/72

[52] U.S. Cl. ..... 229/17 SC; 206/536

[58] Field of Search ..... 229/17 SC, 11, 7 SC; 206/532, 536, 539, 540; 222/162

[56] References Cited

U.S. PATENT DOCUMENTS

| | | | |
|---|---|---|---|
| 1,951,274 | 3/1934 | Denman | 229/17 SC |
| 2,067,723 | 1/1937 | Nahm et al. | 229/17 SC |
| 2,330,926 | 10/1943 | Rous | 229/17 SC |
| 2,387,640 | 10/1945 | Bouchelle | 229/17 SC |
| 3,021,992 | 2/1962 | Phillips, Jr. | 229/17 SC |
| 3,033,436 | 5/1962 | Peimer | 229/17 SC |
| 3,040,953 | 6/1962 | Tindall | 229/17 SC |

*Primary Examiner*—Davis T. Moorhead

*Attorney, Agent, or Firm*—Wolf, Greenfield & Sacks

[57] ABSTRACT

A container for holding and dispensing small articles such as candies, pills and the like is formed from a single die cut blank. The container has an opening in its front wall and a slide is movable vertically behind the front wall to alternataly open or close the opening. The upper end of the slide is attached to one of the hinged top flaps of the container during assembly to enable the slide to be operated by raising or lowering the top flap. The slide portion is attached to the blank by one or more small, rupturable connections which serve to seal the box in a closed position until it is ready for use. The slide embodies an improved construction which retains the slide in place in proximity to the inner surface of the front wall of the box, during its full range of movement.

7 Claims, 8 Drawing Figures

DISPENSER BOX CONSTRUCTION

BACKGROUND AND SUMMARY OF THE INVENTION

This invention relates to improvements in dispenser boxes, for example, of the type which may be used to package small candies, pills, free-flowing products or the like. It is a common current practice to package such articles or products in small containers, frequently made from molded plastic and proivded with a small hinged closure. These boxes are relatively expensive and also are somewhat bulky in that they cannot be shipped from the box manufacturer to the packager in a flat condition. It is among the primary objects of the invention to provide an improved package, useful particularly in connection with small articles which can be made from a flat, die-cut blank at very low cost and which can be shipped in a flat condition. Also among the objects of the invention is to provide an improved construction for a slide closure box in which the assembly and folding of the box from its blank can be achieved with straight line, untimed folding and gluing apparatus, without requiring right angle and/or timed folding or gluing techniques.

In brief, the preferred embodiment of the container is formed from a blank having a plurality of outer or primary panels which are foldable to define the box configuration with two inner supplemental panels which are disposed within the box. One of the inner panels has a detachable slide portion which is connected by one or more small easily ruptured connections. The front wall of the primary panels has an opening which will overlie the slide portion when the box is assembled. The slide portion has a top flap segment which attaches a top flap of the box when the box is assembled. After the slide has been freed, it then is operated by movement of the combined top flaps. The slide also includes an L-shaped construction which fits closely in a corner of the box to guide the slide in its vertical movement and to maintain it in a flat position against the inner surface of the front wall of the box.

It is among the objects of the invention to provide an improved container for small articles.

Another object of the invention is to provide an improved container which is formable from a single blank of die-cut material and which can be made without requiring the use of right angle and/or timed folding and gluing techniques.

A further object of the invention is to provide an endloading container of the type described which is inexpensive and which can be shipped to the packager in a flat configuration.

Another object of the invention is to provide a container of the type described having an improved slide construction means.

DESCRIPTION OF THE DRAWINGS

The foregoing and other objects and advantages of the invention will be appreciated more fully from the following further description thereof with reference to the accompanying drawings wherein.

DESCRIPTION OF THE PREFERRED EMBODIMENTS

Figure 2:
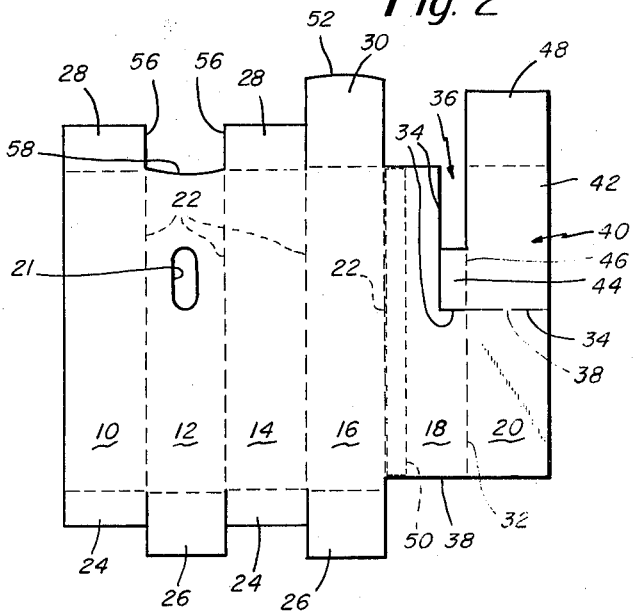
FIG. 2 is a plan view of the blank from which the container is made as seen from the inside surface of the blank.

FIG. 2 shows the die cut blank from which one embodiment of the container is made. The blank may be cut from any suitable sheet material, such as cardboard in an appropriate thickness and composition for the product to be packaged. The blank includes four serially connected primary panels including a first sidewall 10, a front wall 12, a second sidewall 14 and a rear wall 16. A window 21 is formed in the front wall 12. Attached to and extending from the rear wall 16 are a pair of supplementary panels including an inner sidewall 18 and an inner front wall 20. In the embodiment shown, each of the panels 10, 12, 14 and 16 are substantially rectangular and of the same general dimensions, the panels being separated and defined by longitudinally extending score lines 22. The sidewall panels 10 and 14 each include bottom minor flaps 24 extending from each of their lower ends and the front and rear wall panels 12, 16 each include bottom major flaps 26 extending from each of their lower ends. The upper end of each of the sidewalls 10, 14 includes an upper minor flap 28 and the upper end of the rear wall includes an elongated top major flap 30. The upper end of the front wall 12 does not require a flap and none is shown.

The inner sidewall panel 18 and front wall panel 20 are separated and defined by a longitudinally extending score line 32. The inner sidewall panel 18 is generally rectangular except that it is provided with an L-shaped cut 34 in its top corner to define a channel 36. The inner sidewall panel 18 may be slightly shorter than the panels 10-16 and its lower edge 38 may terminate slightly above the lower extremity of the primary panels 10-16. It should be noted that the L-shaped cut line 34 extends into and across the inner front wall panel 20 and is continuous except for one, or perhaps two, small connective portions 38. The horizontal portion of the L-shaped cut line 34 is disposed slightly below the level of the lower end of the window 21 in the front wall 12. Supplemental panels 18, 20 include a slide portion indicated generally by the reference character 40, the slide being defined in part by the cut line 34 and being attached to the inner front wall 20 by the rupturable connective portion 38. The slide 40 is generally L-shaped and includes a main portion 42 and a minor portion 44 which are defined by fold lines 46 which, in turn, is a continuation of fold line 32. A slide flap 48 extends from the upper end of the main portion 42 of the slide 40.

Figure 3:
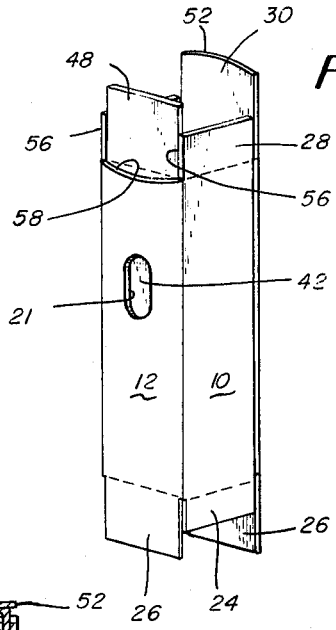
FIG. 3 is an illustration of the blank folded into its intermediate sleeve-like configuration in readiness to be endloaded.
Figure 4:
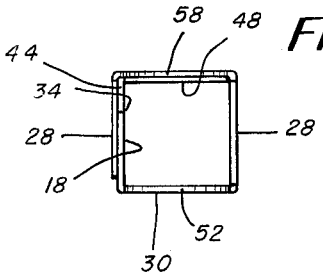
FIG. 4 is an end view of the box configuration shown in FIG. 3.

The blank is assembled to the configuration shown in FIGS. 3 and 4 by folding the various primary and supplemental panels along their fold lines 22, 32, 46 with the supplemental panels 18, 20 being disposed interiorly of the sleeve-like configuration, as shown in FIG. 4.

When the box is folded to its open-ended, sleeve-like configuration, the inner sidewall 18 will lie against the inner surface of the outer sidewall 10 and the inner front wall 20, including its main slide segment 42, will lie behind the front wall panel 12. It should be noted that when folded to this configuration, the slide 40 will be bent to a right angle configuration about the fold line 46 so that the slide 40 will fit within the right angle corner defined by the front wall 12 and sidewall 10. The channel 36 is covered by the sidewall 10 and its edge defined by the cut line 34 cooperates with the edge of the minor slide portion 44 to hold the slide in position. In addition, the natural resilience of the slide 40, in which it will tend to spring back slightly to a flat configuration, holds the slide firmly in place. The container is secured in this open-ended configuration by a strip of adhesive 50 interposed between the marginal edge of the sidewall 10 and the underlying portion of the inner sidewall 18 which has no top or bottom flaps. The glue strip 50 may be applied to the inner sidewall 18 in a straight line, untimed gluing machine.

Figure 5:
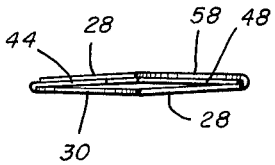
FIG. 5 is an end view of the open ended box folded flat to a shipping and storage configuration.
Figure 6:
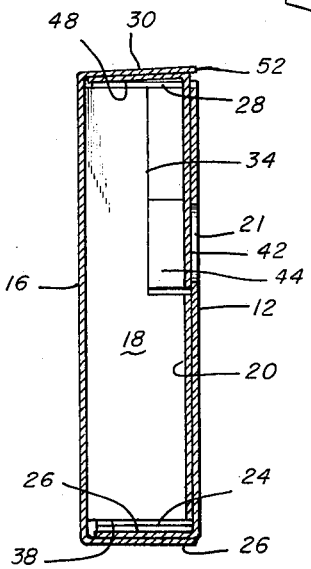
FIG. 6 is a sectional elevation of the container as seen along the line 6-6 of FIG. 1.

The box, in its open-ended configuration then can be fattened to the configuration suggested in FIG. 5 and shipped to the packager who will re-erect the box, close one of the ends, fill the box and then close the other end. For example, the bottom of the box may be closed first by folding the bottom minor flaps 24, then one of the bottom major flaps 26 and then folding and gluing the other of the bottom major flaps in a conventional manner. After the box has been filled with the articles, the upper end may be closed by first folding in the upper minor flaps 28, then the upper flap 48 of the slide 40 and then folding and gluing the upper major flap 30 of the rear wall 16 to the upper flap 48 of the slide 40.

In order to open the box, the user simply pushes the front upper edge 52 of the attached upper flaps 30, 48 sufficiently to rupture the small connective portion 38. That frees the slide 40 to move vertically as the combined flaps 30 and 48 are raised or lowered, pivoting about the connection between the flap 30 and the rear wall 16. Thus, the slide 40 may be raised to open the window 21 and may thereafter be lowered to close the window 21. The main portion 42 of the slide passes between a narrow slot 54 defined between the upper edge of the front wall 12 and the forwardly facing edges 56 of the top minor flaps 28. This, in combination with the retention of the minor portion 44 of the slide 40 in the channel 36 retains the slide 40 in position, in close proximity to and against the inner surface of the front wall 12. The slide, retained and guided in this manner, is assured of proper operation throughout the useful life of the container.

In order to facilitate operation of the slide and to provide a more easily grippable configuration, the outermost edge of the rear wall top flap 30 may be formed in a slight arc as suggested at 52. Also, if desired, the uppermost edge 58 of the front wall 12 may be cut to define an arc in a direction opposite that of forward edge 52 of the flap 30. This further enhances the grippability of the forward edge of the flap 30. One handed operation of the device is simplified because this permits the device to be operated by the user's thumb.

It also should be noted that the configuration described limits the slide movement between upper and lower positions. Limiting the uppermost position of the slide is desirable to preclude the slide from being inadvertently withdrawn from the container with the possibility that it could not thereafter be easily reinserted. The upper limit of slide travel is determined by engagement of the upper portion of the small segment 44 of the slide 40 with one of the end flaps 28. The lower limit of slide travel is determined by engagement of the lower end of the slide 40 with walls 18, 20 as well as by full closure of the attached top flaps 30 and 48.

Figure 1:
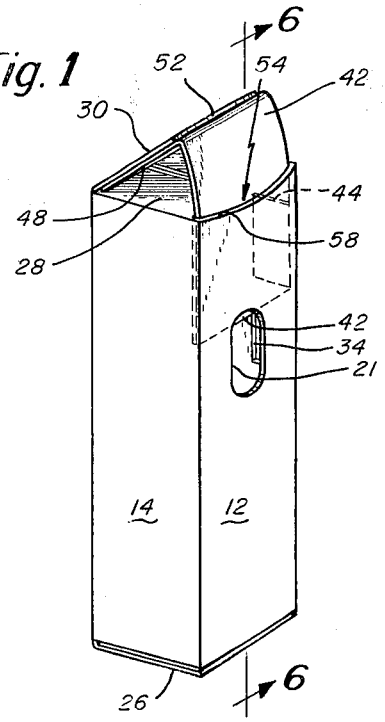
FIG. 1 is an illustration of the container with its slide in its raised, open position.
Figure 7:
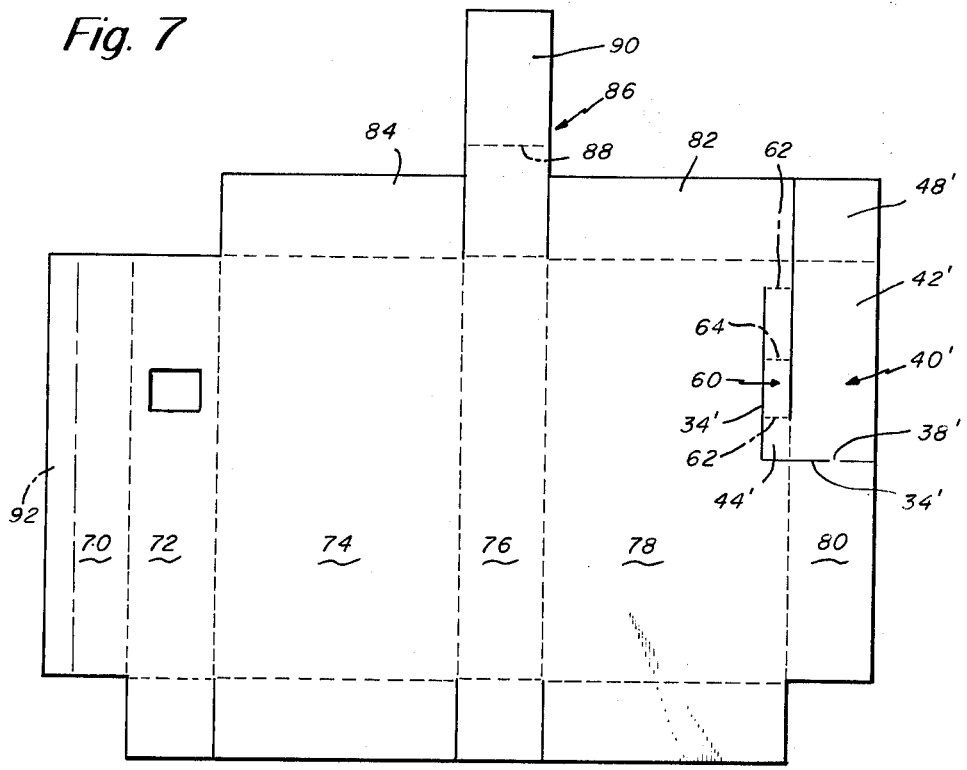
FIG. 7 is a plan view of the blank from which a modified embodiment of the container may be made.
Figure 8:
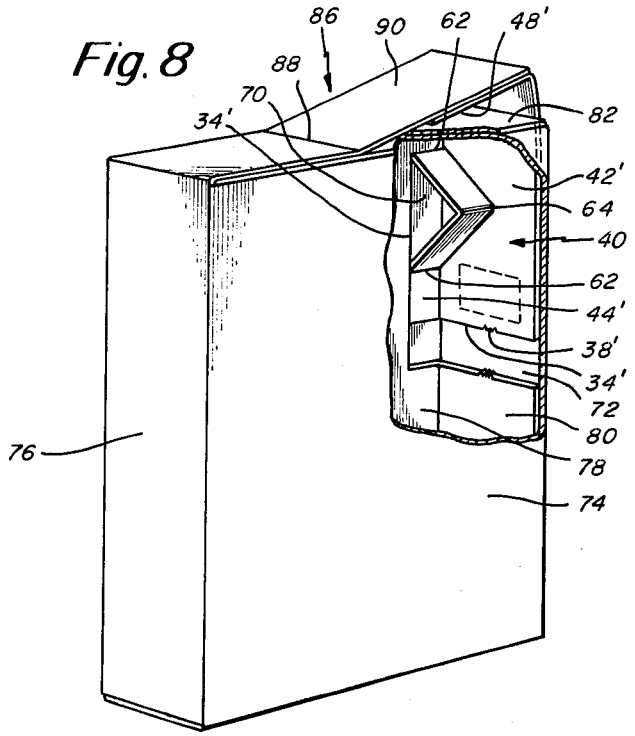
FIG. 8 is an illustration, partly broken away, of the box made from the blank shown in FIG. 7 as seen from the interior of the box.

FIG. 7 shows a blank which is formable into a modified embodiment of the invention illustrated in FIG. 8. The blank shown in FIG. 7 includes a partial outer sidewall or sidewall flap 70, a front wall 72, a sidewall 74, a rear wall 76, a second sidewall 78 and an inner front wall 80. Each of the wall panels 70, 72, 74, 76, 78 and 80 are separated from each other by parallel crease lines. These panels are foldable to the box configuration shown in FIG. 8 in much the similar manner as that described in connection with the embodiment shown in FIG. 1 except that because the sidewall panels 74 and 78 are considerably wider than the corresponding sidewall panels 12, 18, what would correspond to the outer sidewall panel 10 is in the form of a reduced side flap 70. The width of the side flap 70 is sufficient to overlie the region of the strip 60 (as will be explained). In this embodiment, the panels 72, 74, 76 and 78 have lower flaps which are foldable and sealable to define a bottom closure for the box. This embodiment also includes a slide 40' which operates in a similar manner to that described in connection with the first embodiment. As shown in FIG. 7, the slide 40' also includes a primary portion 42' and a minor portion 44'. In this embodiment, the L-shaped cut 34' does not extend fully to the top of the sidewall panel 78 but, rather, terminates short of the top of that panel. This leaves a strip 60, cut at each of its sides but connected at its upper end to the upper region of the sidewall 78 and, at its lower end to the minor slide portion 44'. Transverse crease lines 62 are formed at the opposite ends of the strip 60 and another crease line 64 is formed between the ends of the strip 60 to facilitate bending.

The embodiment shown in FIG. 7 includes some modifications to the upper flaps which result from the more flattened shape of the container. The upper flap 48' is substantially the same as that previously described. In this embodiment, the sidewall 78 has an elongated upper flap indicated at 82 and the other sidewall 74 also has an elongated upper flap indicated at 84. Rear wall 76 also has an upper flap, indicated generally at 86. The upper flap 86 is elongated and is provided with a crease line 88 between its ends to define a hinge by which the more forward portion 90 of the flap 86 may be bent.

The blank shown in FIG. 7 is assembled in a similar manner as described above with regard to the embodiment shown in FIG. 2. The various panels are folded about their respective parallel crease lines with inner front panel 80 lying inside front panel 72. Side flap 70 is attached to the outwardly facing surface of sidewall 78 and overlies the strip 60. Side flap 70, which has no top or bottom flaps, may be attached by a glue strip 92 applied by a straight line gluer to the marginal edge of the side flap 70 as suggested in FIG. 7. There is no glue attachment to the strip 60. When in this configuration, the partly formed box may be flattened and shipped and stored in that configuration. When the box is erected, it is folded out to its rectangular configuration and the bottom flaps are closed. Top flaps 82, 84 and the attached portion of flap 86 are attached to each other to define a top closure. Upper flap 48' is attached to the fully hingeable end 90 of the flap 86.

FIG. 8 shows the mode of operation of this embodiment. The rupturable connection 38′ is broken in the same manner, by urging the forward edge of the hingeable top flap 92 upwardly. Strip 60 will bend at its opposite ends 62 and at its intermediate fold line 64, in a knee-like action suggested in FIG. 8. Operation of the slide and the manner in which it is retained in place is substantially the same as that previously described. Among the features of this embodiment is that there is less chance of the rupturable connection 38′ being inadvertently broken before the package is assembled because of the additional connections of the strip 60 to the sidewall 78 and minor portion 44′ of the slide 40′.

It should be understood that the foregoing description of the invention is intended merely to be illustrative thereof and that other modifications and embodiments may be apparent to those skilled in the art without departing from its spirit. Moreover, it should be understood that terms such as top, bottom, side, upper and lower have been used merely for ease of description and to define the relative locations and directions of movement of the various elements of the invention and are not intended to be used in an absolute sense both in the specification and in the following claims.

Having thus described the invention, what I desire to claim and secure by Letters Patent is:

1. A slide closure container comprising:

a plurality of outer walls folded along parallel fold lines and including a front wall having a window formed therein;

a bottom closure;

a slide disposed within the container behind the front wall, said slide being movable heightwise between a lowered position in which it blocks the window and a raised position in which the window is open;

said container further including a top closure having a forwardly extending flap which is hinged at a location behind the front wall, said flap being connected to the upper end of the slide;

the upper end of at least one of the other walls of the container having a flap which cooperates to form the top closure and which defines a slot in cooperation with the upper edge of the front wall, said slide being slideable through said slot;

said slide including a transversely extending minor portion, folded with respect to the main portion of the slide so that the minor portion will lie against the next adjacent container wall and will fit within the corner defined by said next adjacent container wall and the front wall; and said container being formed in its entirety from a single, one piece blank.

2. A slide closure container as defined in claim 1 further comprising:

said minor portion of said slide being disposed at the lower end of the slide thereby to interfere with the minor upper flap to determine the uppermost position of the slide.

3. A blank formable into a slide closure container comprising:

a plurality of four serially connected primary panels including a first sidewall panel, an outer front wall panel, a second sidewall panel and a rear wall panel, each of said panels being defined with respect to each other by parallel longitudinally extending fokld lines;

a pair of supplemental panels attached to and extending from the rear wall panel, said supplemental panels including an inner sidewall panel and an inner front wall panel;

said blank being foldable into a rectangularly shaped container in which the supplemental panels are disposed within the container with the inner sidewall panel disposed behind the first sidewall and the inner front wall panel being disposed behind the outer front wall panel;

bottom flaps attached to and extending from the lower ends of the primary panels and being foldable to define a bottom closure;

each of the first and second sidewall panels having a minor flap extending from the upper end thereof;

a major flap extending from the upper end of the rear wall panels;

said inner sidewall and inner front wall having an L-shaped cut formed therethrough, said cut extending longitudinally along the inner sidewall from its upper end and then transversely toward and through the inner front wall except for at least one interruption in said L-shaped cut, said L-shaped cut defining a slide portion which remains connected to the inner front wall by a rupturable connection defined by said interruption;

said slide having a main portion in alignment with the inner front wall panel and a minor portion extending transversely from the main portion, said minor portion being defined in part by said L-shaped cut;

the upper end of the slide including a flap which is attachable to the top hinged flap when the box is assembled;

the horizontal portion of the L-shaped cut being disposed below the lower end of the window formed in the front wall panel;

the major and minor portions of the slide being foldable along a longitudinally extending line to conform to the interior corner configuration defined between the front wall and the first sidewall;

said L-shaped cut line further defining a longitudinally extending channel at the upper side of the inner sidewall within which the minor portion of the slide may pass.

4. A container formed from the blank defined in claim 3.

5. A blank formable into a slide closure container as defined in claim 3 further comprising:

said L-shaped cut beginning at a location which is spaced from the upper end of the inner sidewall to define a strip connected at its upper end to the upper region of said sidewall and, at its lower end to the minor portion of the slide;

said strip being foldable at its connected portions to said sidewall and said minor portion of said slide and being foldable intermediate its ends.

6. A container formed from the blank defined in claim 5.

7. A slide closure container comprising:

a plurality of outer walls folded along parallel fold lines and including a front wall having a window formed therein;

a bottom closure;

a slide disposed within the container behind the front wall, said slide being movable heightwise between a lowered position in which it blocks the window and a raised position in which the window is open;

said container further including a top closure having a forwardly extending flap which is hinged at a location behind the front wall, said flap being connected to the upper end of the slide;

the upper end of at least one of the other walls of the container having a flap which cooperates to form the top closure and which defines a slot in cooperation with the upper edge of the front wall, said slide being slideable through said slot;

said slide including a transversely extending minor portion, folded with respect to the main portion of the slideso that the minor portion will lie against the next adjacent container wall and will fit within the corner defined by said next adjacent container wall and the front wall; and at least one of the walls of the container being free of any top or bottom flaps thereby to facilitate application of a glue strip thereto in a straight line, untimed manner.

* * * * *